United States Patent [19]

Openchowski et al.

[11] 4,157,693

[45] Jun. 12, 1979

[54] SEAMLESS DRAWN AND IRONED CONTAINER WITH OPENING MEANS AND METHOD AND APPARATUS FOR FORMING THE SAME

[75] Inventors: Richard A. Openchowski, Woodridge; Joseph A. Bronec, Chicago, both of Ill.

[73] Assignee: National Can Corporation, Chicago, Ill.

[21] Appl. No.: 850,215

[22] Filed: Nov. 10, 1977

[51] Int. Cl.[2] ..... B21D 51/38

[52] U.S. Cl. ..... 113/120 H; 113/7 R

[58] Field of Search ..... 113/120 H, 120 R, 1 G, 113/7 R, 7 A, 15 R, 15 A, 121 R, 121 C; 220/268; 72/348

[56] References Cited

U.S. PATENT DOCUMENTS

| | | | |
|---|---|---|---|
| 3,300,080 | 1/1967 | Close | 220/273 |
| 3,301,433 | 1/1967 | Wade | 113/121 C |
| 3,302,823 | 2/1967 | Hulse | 220/270 |
| 3,339,789 | 9/1967 | Stolle et al. | 220/270 |
| 3,430,593 | 3/1969 | Stolle et al. | 113/121 R |
| 3,446,167 | 5/1969 | Armbruster et al. | 113/7 R |
| 3,448,887 | 6/1969 | Geiger | 220/273 |
| 3,726,244 | 4/1973 | Arangelovich | 113/120 H |
| 3,881,437 | 5/1975 | Lovell et al. | 113/121 C |
| 3,938,455 | 2/1976 | Urmston | 113/15 A |
| 4,062,311 | 12/1977 | Zugcic | 113/7 R |

*Primary Examiner*—Michael J. Keenan

*Attorney, Agent, or Firm*—Robert A. Stenzel; Ralph R. Rath

[57] ABSTRACT

A method and apparatus for forming a seamless container having a sidewall and an integral end wall with opening means in the integral end wall is disclosed herein. The method contemplates forming at least one substantially closed area of reduced thickness in the end wall to produce a fracturable web that defines an opening means during the conversion of a flat disc to a finished container. In one form, the method contemplates initially forming a shallow cup and then forming the opening means in the end wall of the shallow cup before the cup is converted into a drawn and ironed container. In another form, the opening means is formed while the container end wall is being reformed into its final configuration and in a further version, the end opening means is formed in the end wall after completion of the drawing and ironing process. The finished container includes a reformed end wall that is integral with a circular sidewall of a container and has a fracturable web surrounding a protuberance. The invention also contemplates apparatus for carrying out the above method and results in a container which may have a flat end panel attached to the open end of the drawn and ironed container to produce a beverage package.

11 Claims, 14 Drawing Figures

SEAMLESS DRAWN AND IRONED CONTAINER WITH OPENING MEANS AND METHOD AND APPARATUS FOR FORMING THE SAME

BACKGROUND OF THE INVENTION

The present invention relates generally to containers and more particularly to drawn and ironed containers.

The use of two-piece containers for packaging beer and/or carbonated beverages has become very popular in recent years. The two-piece container consists of a cylindrical container body that has a unitary end wall at one end thereof. A converted end having an opening mechanism is usually then double seamed to the open end of the container to produce a complete package.

In the formation of a drawn and ironed container, a flat circular disc is normally cut from a blank of stock material and is substantially simultaneously transformed into a shallow cup. This is done in a cupping machine or cupper in a can manufacturing plant.

The shallow cup is then transferred to a body maker, such as a drawing and ironing machine, wherein the shallow cup is initially reformed into a cup of different dimensions and substantially simultaneously passed through a plurality of ironing rings or dies which cooperate with a punch to decrease the wall thickness or the reformed cup and to transform the cup into a seamless container having a sidewall and an integral end wall. At the end of the stroke of the punch, the end wall is usually reformed to some configuration, such as an inwardly directed dome, to increase the pressure resistance of the container when the contents in the container are pressurized.

At the present time, most ends that are utilized for closing the open end of a drawn and ironed container incorporate the conventional type of removable tear strip as the opening means. In forming the finished end, a flat circular disc is reformed to have a flat central portion surrounded by a countersink at the periphery thereof and a peripheral flange or rim at the free end of the countersink which is adapted to be double seamed to the open end of the drawn and ironed container. This partially finished end is then converted to a complated end in a conversion press which normally has six stations with an integral rivet for connecting an opening tab being formed at the first and second station. At the third station, the end is scored to produce the removable section or tear strip while the tab is staked to the tear strip at the fourth and fifth stations. At the last station, the central panel is transformed to its final configuration, such as producing the desired stengthening beads as well as the indicia that is desired on the finished end.

With the recent emphasis on ecology, all can manufacturers are attempting to produce a container wherein the opening means remain with the container after the contents have been consumed. Examples of these types of ends include what is referred to as the "button" end in which one or two circular scores are produced in the end panel which is attached to the container body with a portion being unscored to define a permanent connection between the button and the remainder of the end. Another example of present attempts to produce an ecology end includes some type of permanent connection between the present day generally conventional tear strip and the remainder of the container. All of these attempts are directed towards producing an improved end which can be attached to a container body.

SUMMARY OF THE INVENTION

According to the present invention, a container for packaging beer and/or carbonated beverages can be produced without the use of the present day well known conversion press. According to the present invention, the opening means is formed in the integral end wall of a drawn and ironed container so that a flat end can be attached to the opposite open end.

According to the broadest aspect, the present invention contemplates forming a substantially closed area of reduced thickness in an end wall of a drawn and ironed container to produce a fracturable web or score that defines an opening panel of reduced size in the end wall which is integral with the sidewall of the container. The fracturable web is produced by a set of cooperating members, one of which consists of a scoring tool that produces a score in the integral end wall of the drawn and ironed container. Preferably, the opening means or panel has a protuberance produced therein during the formation of the score which will subsequently assist in severing the score when the container is to be opened.

According to the method aspect of the invention, the opening means or panel may be formed after the circular disc has been transformed into a shallow cup and then the shallow cup is delivered to the drawing and ironing machine for the conventional ironing process. In another form of the invention, the opening means is produced in the drawing and ironing machine simultaneous with the reformation of the end wall to its final configuration. In a further version of the invention, the opening means is produced in the drawn and ironed container in a separate operation after the end wall is in its final cross-sectional configuration.

With any of the methods described above, the end wall of the drawn and ironed container may initially be coined to produce a reduced cross-sectional thickness in which the opening means is subsequently produced.

The finished container preferably has two such opening means located at diametrically opposed points in the end wall adjacent the periphery thereof and the opening means are formed in the inwardly directed dome portion of the end.

DETAILED DESCRIPTION

Figure 1:
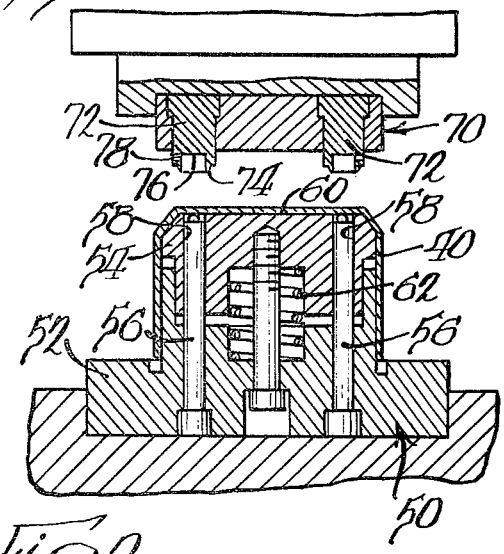
FIG. 1 discloses a fragmentary sectional view of a portion of a press having cooperating members that are utilized for forming opening means in an integral end wall of a drawn cup.

While this invention is susceptible of embodiment in many different forms, there is shown in the drawings and will herein be described in detail preferred embodiments of the invention with the understanding that the present disclosure is to be considered as an exemplification of the principles of the invention and is not intended to limit the invention to the embodiments illustrated.

Figure 6:
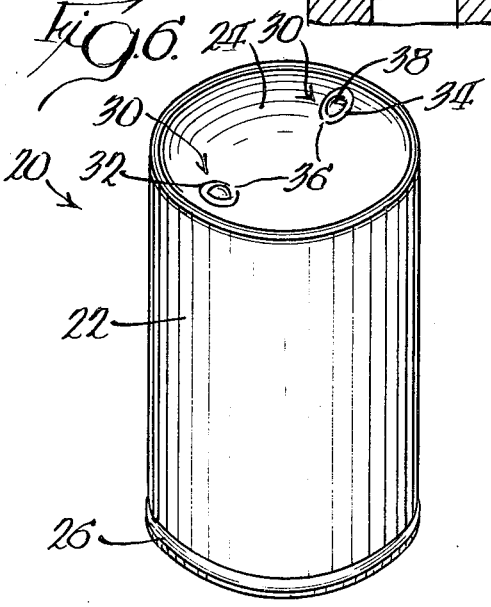
FIG. 6 is a perspective view of the finished container constructed in accordance with the present invention.

FIG. 6 of the drawings shows a container generally designated by reference numeral 20 constructed in accordance with the teachings of the present invention. Container 20 is formed of metal, such as tinplate, aluminum or black plate, and has a cylindrical sidewall 22 and a concave or inwardly domed end wall 24. The open end of cylindrical wall 22 has a flange 26 defined thereon for attaching an end panel to complete the container.

According to the present invention, opening means 30 are formed in the integral end wall of the drawn and ironed container 20. Each opening means 30 is formed by producing a substantially closed area of reduced thickness 32 which produces a frangible web or score that defines an opening panel 34. Opening panel 34 has a small unscored portion 36 which defines a permanent connection between opening panel 34 and the remainder of the container end wall 24. Opening panel 34 also has a central raised protuberance 38 which extends away from cylindrical sidewall 22, for a purpose that will be described later.

According to one aspect of the invention, opening means 30 are formed in the container end wall 24 while a flat metal disc is being converted into a finished container as illustrated in FIG. 6. In the embodiment illustrated in FIGS. 1 through 5, a flat metal disc is converted into a generally shallow cup 40 (FIG. 3) in a conventional well known process (not shown) such as a press having a punch that cooperates with a drawing ring to transform a flat disc into cup 40. The punch and ring may be considered to be a first pair of cooperating members that are adapted to convert a disc into a cup 40 which has a sidewall 42 and an integral substantially flat end wall 44 which merge with each other along a generally flat inclined annular wall portion 46. Cylindrical sidewall 42 ultimately becomes the ironed sidewall 22 of the finished container while end wall 44 becomes the integral domed end wall 24, as will be described later.

Figure 2:
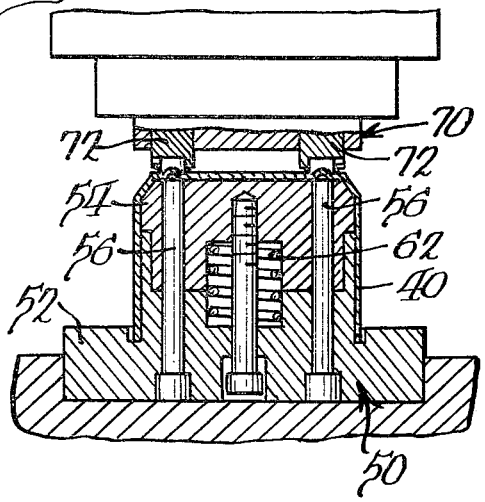
FIG. 2 is a view similar to FIG. 1 showing the press in a closed condition.
Figure 3:
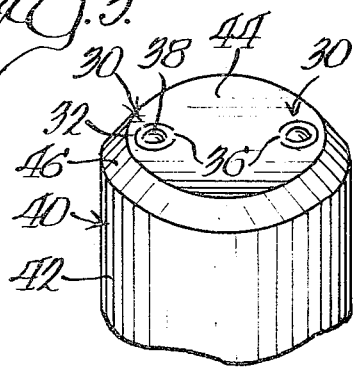
FIG. 3 is a fragmentary perspective view of the cup having the opening means formed therein.

Before the shallow cup 40 is converted into the finished container, a further set of cooperating members are utilized for producing the opening means 30 into end wall 44 of the cup 40. As illustrated in FIGS. 1 and 2, the set of cooperating members includes a first member 50 having first and second elements 52 and 54 which cooperate to support cup 40 for producing opening means 30. For this purpose, element 52 has a pair of pins 56 which extend from an upper free end thereof through a pair of openings 58 in upper element 54. Elements 52 and 54 are urged away from each other by biasing means or a spring 62 to a position where the free ends of pins 56 are located below the upper surface 60 of element 54 which defines a contact surface for engaging the inner surface of end wall 44.

A second cooperating member 70 has a pair of scoring tools 72 supported thereon and each scoring tool has a generally circular peripheral scoring edge 74 surrounding a recess 76. Recess 76 is in communication with the periphery of scoring tool 72 through an opening 78.

Scoring tools 72 are dimensioned and positioned so that peripheral scoring edge 74 surrounds opening 58 and cooperates with surface 60 to produce a frangible web or score 36 in end wall 44. As the frangible web or score is being formed, the force of the two cooperating members 50 and 70 moving towards each other will overcome the bias of spring 62 and cause the upper element 54 to bottom out on the lower element 52 while forcing the free ends of pins beyond contact surface 60 to simultaneously produce the protuberances 38. The protuberance or bubble, located in the center of the opening panel 34, serves to stretch and thin the metal before the score line 32 is produced. As indicated above, preferably the scoring tool has a relief area which results in an unscored portion 36.

Figure 4:
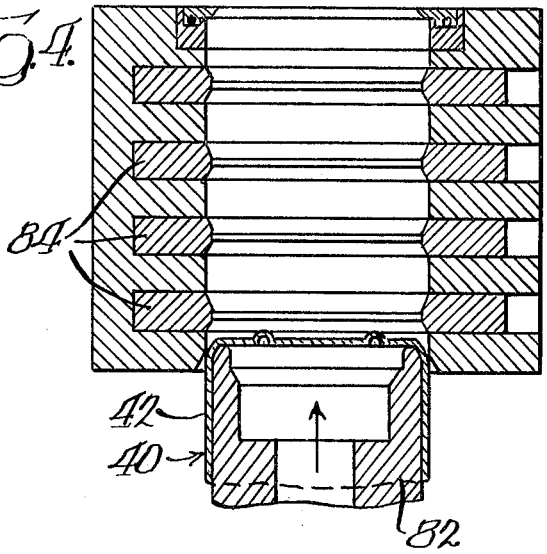
FIG. 4 is a fragmentary cross-sectional view of a drawing and ironing machine for converting the cup illustrated in FIG. 3 to a drawn and ironed container.
Figure 5:
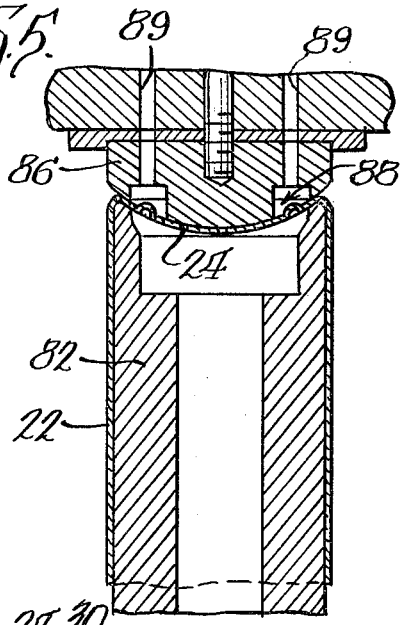
FIG. 5 shows the last phase of transforming the cup into a container.

After the cup 40 with opening means 30 in end wall 44 is formed, the cup is then converted into a finished container, as will now be described. Cup 40 is converted into a finished container using a further set of cooperating members that are illustrated in FIGS. 4 and 5. Referring to FIG. 4, the cooperating members include a punch 82 which is adapted to have a cup 40 received thereon and cooperates with a plurality of ironing rings 84 to reduce the wall thickness of sidewall 42 as the cup is being forced through the respective ironing rings. If desired, the cup may initially be formed of a larger diameter and be reduced by redrawing the cup with a redrawn ring before the cup is forced through the ironing rings. At the end of the stroke of the punch 82, punch 82 cooperates with a die or doming member 86 which reforms the substantially flat wall to a generally domed configuration as illustrated in FIG. 5. In order to insure that the score for each of the opening means 30 is not fractured during such reforming of the end panel or end wall, recesses 88 are formed in doming element 86 and are aligned with opening means 30 as illustrated in FIG. 5. Recesses 88 are vented to atmosphere through vent openings 89 to prevent pressure buildup which could fracture score line 32.

After the end wall 24 and sidewall 22 of container 20 have been reformed and ironed, the partially finished container 20 is removed from punch 82 utilizing well known stripper means that engage the free end of the container so that the container is stripped from the punch. The free edge of container 20 is then trimmed to the desired height and flange 26 is formed thereon in a manner well known in the art.

Figure 7:
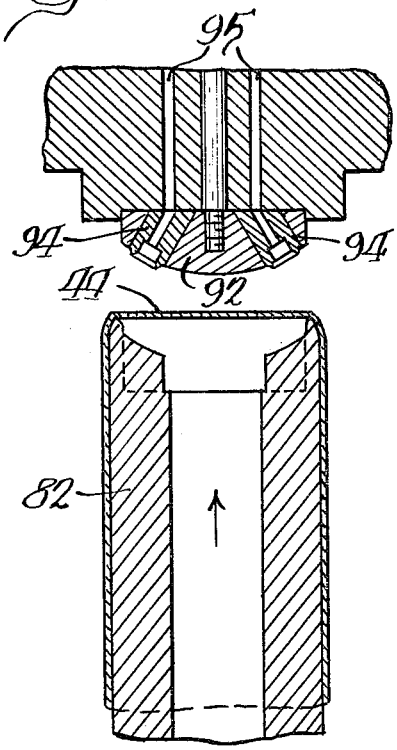
FIG. 7 illustrates a fragmentary cross-sectional view of a pair of cooperating members that can be utilized for forming the opening means simultaneously with reforming the end wall of the drawn and ironed container.
Figure 8:
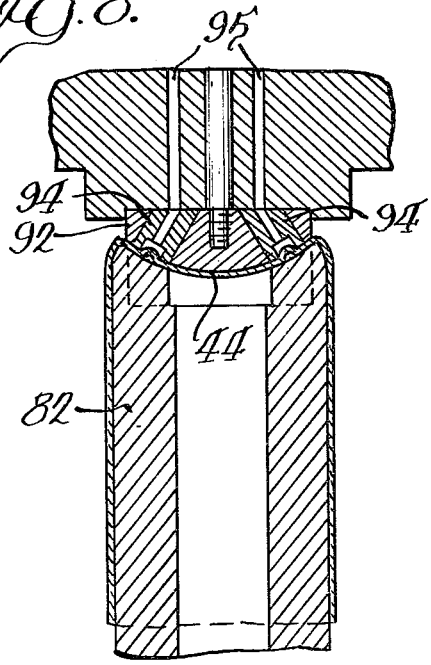
FIG. 8 is a view similar to FIG. 7 showing the tooling or cooperating members in their closed condition.

A slightly modified form of apparatus for producing the container illustrated in FIG. 6 is shown in FIGS. 7 and 8. In this version of the invention, the flat disc is converted to a cup in a conventional well known press and the cup is converted into a container in a body maker or drawing and ironing machine utilizing the ironing rings and punch as illustrated in FIG. 4. In this version of the invention, with slight modification of the tooling, the opening means 30 can be produced substantially the same time the end wall of cup 40 is reformed to its final configuration. As illustrated in FIGS. 7 and 8, punch 82 may be substantially identical as the punch described in connection with the embodiment illustrated in FIGS. 4 and 5. In this version of the invention, the cooperating die or domer 86 is replaced with a special type of domer 92 which has a pair of scoring tools 94 supported therein and the scoring tools may be substantially identical to scoring tools 72 described above. In this version of the invention, vent openings 95 are provided for venting the internal openings or recesses of scoring tools 94.

FIG. 7 illustrates the arrangement of the die 92 and punch 82 after the cup has been transformed into a drawn and ironed container by being spaced through die rings 84. At the end of the stroke for punch 82, the flat end wall 44 of cup 40 is transformed from the condition illustrated in FIG. 7 to that illustrated in FIG. 8 wherein opening means 30 are simultaneously produced as the end wall is transformed to wall 24. By relieving the pressure through vents 95 that may be developed internally of the recesses of scoring tools 94, the protuberance is automatically formed by the pressure of the trapped air within the space between wall 44 and punch 82 and insures that the protuberance is forced outwardly while the end wall is being transformed into a generally concave inwardly directed member.

Figure 9:
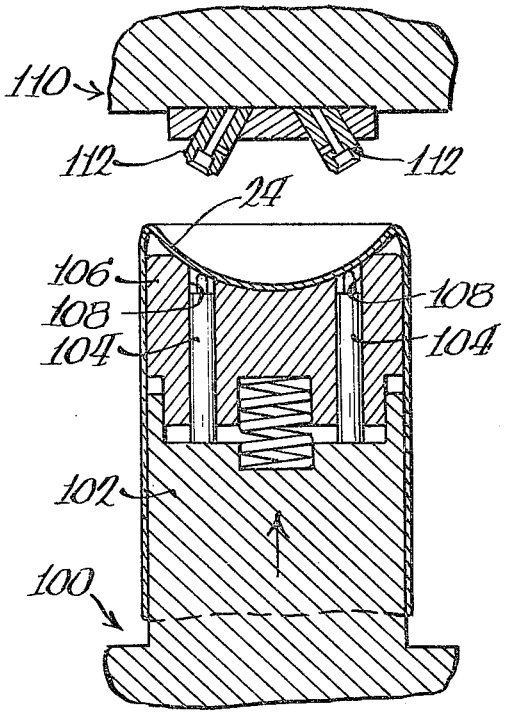
FIG. 9 is a view similar to FIG. 7 showing a modified form of the invention wherein the opening means are formed after the end wall has been reformed.
Figure 10:
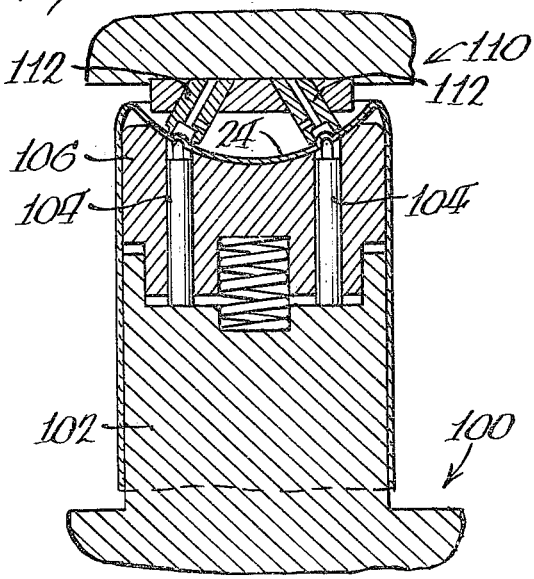
FIG. 10 is a view similar to FIG. 8 showing the cooperating members in a closed condition.
Figure 11:
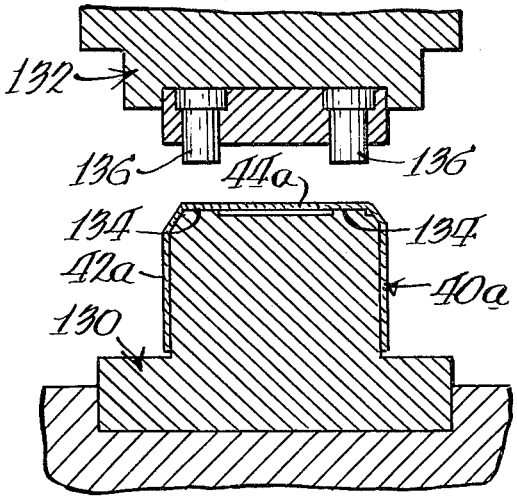
FIGS. 11 and 12 are views similar to FIGS. 1 and 2 showing a preliminary coining step for the cup before the opening means are formed therein.

FIGS. 9 and 10 show a further modified form of the invention wherein opening means 30 are formed as a separate step after cup 40 has been transformed into a container wherein the end wall 24 has been reformed. In this embodiment of the invention, a punch or cooperating member 100 consists of a first element 102 having pins 104 and a second element 106 having openings 108 cooperates with a second member 110 that has a pair of scoring tools 112. In this version of the invention, the opening means 30 are formed in a manner very similar to that described above in connection with the formation of cup 40. However, the opening means in this version of the invention are formed after the drawn and ironed container has been fully ironed and the end wall has been reformed.

One of the unique features of the invention disclosed in the embodiments illustrated in FIGS. 7–10 is the fact that the weakened line is actually formed in the domed portion of the integral end wall of the container. So far as presently known, the formation of the opening means on a domed end has never been previously attempted.

A further slightly modified form of the invention is illustrated in FIGS. 11 through 14. In this version of the invention, a substantially coined circular reduced area is formed in the end wall of the cup for each opening means and the opening means is subsequently formed in the coined reduced area. In this version of the invention, a pair of cooperating members 130 and 132 cooperate to produce circular coined areas of reduced thickness in end wall **44*a* of cup 40*a* after the cup has been drawn to the configuration illustrated in FIG. 11. Lower member or die 130 has a pair of circular raised portions 134 while upper member or die 132 also has a pair of circular pins or projections 136 aligned with raised portions 134. As the dies or cooperating members 130 and 132 are moved towards each other from the position illustrated in FIG. 11 to that illustrated in FIG. 12, circular coined areas of reduced thickness are formed in end wall 44*a* of cup 40*a*. This arrangement has an advantage in that it reduces the difficulty that might be encountered in finally producing the fracturable web or score. It will be appreciated that normally in the formation of drawn and ironed containers, the end wall of the finished container is substantially the same thickness as the initial thickness of the disc for utilizing the drawn and ironed container. By reducing the cross-sectional thickness in selected areas of the end wall, more accurate control can be maintained in producing the finished score line that defines opening means 30**.

Figure 13:
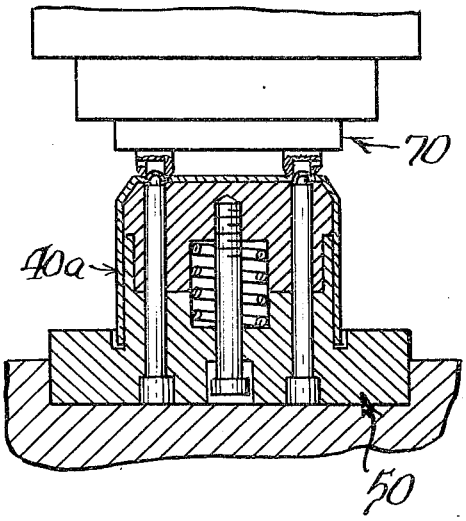
FIG. 13 is a view similar to FIG. 2 showing the formation of the opening means in the coined areas of the end wall.
Figure 12:
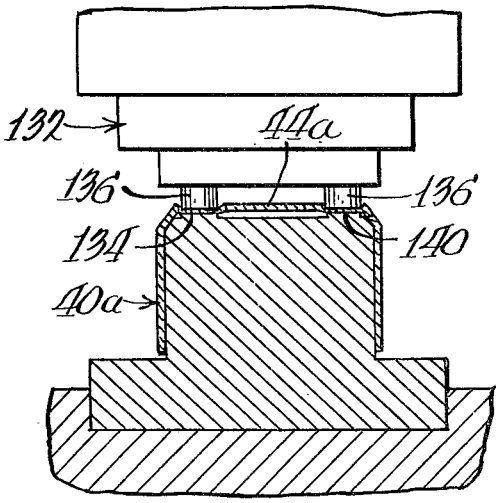

As illustrated in FIG. 13, after the circular coined areas of reduced cross section 140 are formed in end wall **44*a*, cooperating members 50 and 70 may be utilized for producing the respective opening means 70 in the respective coined area of reduced cross section 140**.

Figure 14:
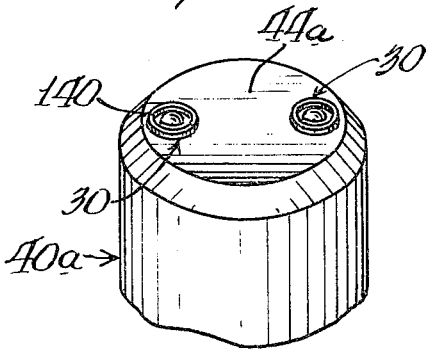
FIG. 14 is a fragmentary perspective view of the cup with the opening means formed therein.

The cup **40*a* with the opening means 30 produced in coined areas 140 of end wall 44*a* is illustrated in FIG. 14. Cup 40*a* may then be converted to a finished container utilizing the apparatus illustrated in FIGS. 4 and 5. The concept of pre-coining the end wall of the metal could be incorporated into all forms of the invention described above. For example, the flat blank could be initially coined or the bottom wall of the cup could be coined and the remainder of the processes illustrated in FIGS. 1–8** could be performed.

In all forms of the invention, the opening means 30 have protuberances formed therein which define a pressure point where force can be applied to fracture the score 32. The resulting drinking aperture is then located close to the rounded portion of the perimeter of the end wall which results in a comfortable drinking position for the consumer's mouth.

The finished container produced according to the present invention can have a flat end seamed thereto which eliminates the need for conversion tooling and also eliminates the need for a separate tab to open the container.

While one type of opening means has been shown and described, it will be appreciated that other configurations and versions of opening means could be formed in the integral end wall of a drawn and ironed container. For example, opening panel 34 could initially be produced by severing score line 32 and then applying a plastisol sealant to the inner surface of the end wall of the container.

What is claimed is:

1. Apparatus for converting a disc into a seamless container having a sidewall and an integral end wall with opening means in said end wall including a first pair of cooperating members adapted to convert said disc into a cup and a second set of cooperating members adapted to convert said cup into an ironed seamless container having a reformed end wall, the improvement of said apparatus including a further set of cooperating members for engaging opposed surfaces of said reformed end wall for producing a fracturable web in said end wall of said container to produce said opening means therein, said further set of cooperating members including first and second cooperating members with said first member including first and second elements with one of said elements having an opening extending from a contact surface adapted to engage said end wall and the other of said elements has a pin received in said opening with a free end of said pin adjacent said contact surface, and biasing means between said elements normally maintaining said free end of said pin in said opening, and in which said second member includes a scoring tool cooperating with said contact surface adjacent said opening so that initial engagement of said contact surface with said end wall will cause said free end of said pin to engage said end wall and will produce a protuberance in said opening means.

2. Apparatus as defined in claim 1, in which said further set of cooperating members engage the end wall of said cup to produce said opening means before said cup is converted to a seamless container.

3. Apparatus as defined in claim 1, in which said further set of cooperating members engage said end wall after said cup is converted to a seamless container.

4. Apparatus as defined in claim 1, further including an additional set of cooperating members for engaging said end wall to produce a coined area of reduced thickness and in which said fracturable web is formed in said coined area.

5. In a method of drawing and ironing a metal container from a flat metal disc comprising the steps of drawing said disc into a cup having a sidewall and an integral end wall, ironing said sidewall to reduce the wall thickness thereof, and reforming said end wall, the improvement of coining a reduced area in said end wall of said cup, producing a protuberance in said coined area extending away from said sidewall, and forming a substantially closed area of reduced thickness in said coined area of said cup to produce a fracturable web defining an opening panel of reduced size in said end wall.

6. In a method of drawing and ironing a metal container from a flat circular metal disc comprising the steps of drawing said disc into a cup having a sidewall and an integral end wall, ironing said sidewall to reduce the wall thickness thereof, and reforming said end wall, the improvement of inwardly doming said end wall and forming two diametrically opposed substantially closed areas of reduced thickness in said end wall to produce fracturable webs defining a pair of opening panels of reduced size in said end wall during said doming step.

7. In a method of drawing and ironing a metal container from a flat metal disc comprising the steps of drawing said disc into a cup having a sidewall and an integral end wall, ironing said sidewall to reduce the wall thickness thereof, and reforming said end wall, the improvement of, prior to said ironing and reforming steps, forming a protuberance in the end wall of said cup and a fracturable web around said protuberance to produce an opening panel.

8. A method as defined in claim 7, in which said protuberance and fracturable web are formed in the end wall after said disc is formed into a cup.

9. A method as defined in claim 8, including the further step of coining a reduced area in the end wall of said cup and subsequently forming said protuberance and fracturable web in said reduced area.

10. A method as defined in claim 7, in which two spaced opening panels are simultaneously formed in said end wall.

11. A method as defined in claim 7, in which the fracturable web is severed during formation of said opening panel, including the further step of applying a sealant along the severed area.

* * * * *